US006123416A

United States Patent [19]

Minemoto et al.

[11] Patent Number: 6,123,416

[45] Date of Patent: Sep. 26, 2000

[54] INKJET APPARATUS AND METHOD FOR EJECTING PARTICULATE MATTER FROM AN EJECTION ELECTRODE USING AN ELECTRIC FIELD

[75] Inventors: Hitoshi Minemoto; Yoshihiro Hagiwara; Ryousuke Uematsu; Tadashi Mizoguchi; Junichi Suetsugu; Hitoshi Takemoto; Kazuo Shima; Toru Yakushiji, all of Niigata, Japan

[73] Assignee: NEC Corporation, Tokyo, Japan

[21] Appl. No.: 08/903,766

[22] Filed: Jul. 31, 1997

[30] Foreign Application Priority Data

Jul. 31, 1996 [JP] Japan ..... 8-201761
Aug. 9, 1996 [JP] Japan ..... 8-226100

[51] Int. Cl.[7] ..... B41J 2/04

[52] U.S. Cl. ..... 347/55

[58] Field of Search ..... 347/55, 56, 103; 399/271, 290, 292, 293, 294, 295

[56] References Cited

U.S. PATENT DOCUMENTS 4,396,925 8/1983 Kohashi ..... 346/140
4,447,821 5/1984 Yuasa ..... 346/154
4,710,784 12/1987 Nakayama ..... 346/140
4,794,463 12/1988 Tamura ..... 358/296

FOREIGN PATENT DOCUMENTS 0 778 138 6/1997 European Pat. Off. .

*Primary Examiner*—John Barlow
*Assistant Examiner*—Raquel Yvette Gordon
*Attorney, Agent, or Firm*—Foley & Lardner

[57] ABSTRACT

An electrostatic inkjet apparatus includes a plurality of ejection electrodes and a plurality of control electrodes. The ejection electrodes are arranged in an ink chamber for containing ink including particulate matter with protruding from a front end of the ink chamber. The control electrodes are arranged in the ink chamber such that each of the ejection electrodes is placed between two adjacent control electrodes. A voltage controller applies a control voltage to two control electrodes adjacent to a selected ejection electrode which is in a floating state and thereby a potential of the selected ejection electrode is changed to an ejection level.

12 Claims, 8 Drawing Sheets

1ST VOLTAGE GENERATOR
401
2ND VOLTAGE GENERATOR
402
3RD VOLTAGE GENERATOR
403
404
EJECTION ELECTRODE OR CONTROL ELECTRODE
$V_{HD}$
$D_1$
$D_2$
$D_3$
$TR_1$
$TR_2$
$TR_3$
$TR_4$
$TR_5$
$TR_6$
$TR_7$
$TR_8$
$TR_9$
$R_1$
$R_2$
$R_3$
$R_4$
$R_5$
$R_6$
$R_7$
$R_8$
$R_9$
$R_{10}$
$R_{11}$
$R_{12}$
$S_{B1}$
$S_{B2}$
$S_{C1}$
$S_{C2}$
$S_{P1}$
$S_{P2}$

FIG. 8

| TRANSISTORS ON/OFF CONTROL | | | | | | OUTPUT VOLTAGE |
|---|---|---|---|---|---|---|
| $TR_1$ ($TR_2$) | $TR_3$ | $TR_4$ ($TR_5$) | $TR_6$ | $TR_7$ ($TR_8$) | $TR_9$ | |
| ON | ON | OFF | OFF | OFF | OFF | Vb |
| OFF | OFF | ON | ON | OFF | OFF | Vc |
| OFF | OFF | OFF | OFF | ON | ON | Vp |
| OFF | OFF | OFF | OFF | OFF | OFF | FLOATING |

INKJET APPARATUS AND METHOD FOR EJECTING PARTICULATE MATTER FROM AN EJECTION ELECTRODE USING AN ELECTRIC FIELD

BACKGROUND OF THE INVENTION

1. Field of the Invention

The present invention relates to an apparatus employing an inkjet recording method, and more particularly to an apparatus which ejects particulate matter such as pigment matter and toner matter from an ejection electrode by making use of an electric field and a control method for the apparatus.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. As one of the inkjet recording methods, there is an electrostatic inkjet recording method.

The electrostatic inkjet recording apparatus generally has an electrostatic inkjet recording head and a counter electrode which is disposed behind the recording medium to form an electric field between it and the recording head. The electrostatic inkjet recording head has an ink chamber which temporarily stores ink containing toner particles and a plurality of ejection electrodes formed near the end of the ink chamber ad directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrodes, and printing is performed. A recording head such as this to disclosed, for example, in Japan Laid-Open Patent Publication No. 60-228162 and PCT International Publication No. WO93/11866.

Particularly, in the Publication (60-228162), there is disclosed an electrostatic inkjet printer head where a plurality of ejection electrodes are disposed in an ink nozzle, and the front end of each ejection electrode is formed on the projecting portion of a head base which projects from the ink nozzle. The front end of this projecting portion has a pointed configuration, and the ejection electrode is formed in accordance with the direction of the pointed end. An ink meniscus is formed near the front end of the ejection electrode.

In the conventional electrostatic inkjet device as mentioned above, when voltage pulses are consecutively applied to an ejection electrode in relatively short intervals, the particulate ratter is supplied to the front end of the ejection electrode and then is jetted toward the counter electrode, However, in cases where the time interval between voltage pulses is long, the particulate matter withdraws from the front end of the ejection electrode because of reduced electrostatic force during the interval. In such a state, when the voltage pulse is applied, the particulate matter cannot be instantly jetted. Therefore, no ink may be jetted by that ejection electrode, resulting in deteriorated quality of printing.

Further, in the conventional electrostatic inkjet device, an ejection electrode which is not driven is grounded. Therefore, when an ejection electrode is driven and the adjacent ejection electrodes are not driven, an electric field is generated between the driven ejection electrode and the adjacent ejection electrodes. The electric field generated between them causes the particulate matter in the ink to drift away from the driven ejection electrode, resulting in deteriorated quality of printing.

SUMMARY OF THE INVENTION

An object of the present invention is to provide a method and apparatus which can eject ink from an ejection electrode with reliability and stability.

Another object of the present invention is to provide a method and an apparatus which are capable of stably ejecting ink from a plurality of ejection electrodes.

According to the present invention, an electrostatic inkjet apparatus includes a plurality of ejection electrodes and a plurality of control electrodes. The ejection electrodes are arranged in an ink chamber containing ink including particulate matter and protrude from a front end of the ink chamber. The control electrodes are arranged in the ink chamber such that each of the ejection electrodes is placed between two adjacent control electrodes. The apparatus further includes a controller which applies a control voltage to two control electrodes adjacent to a selected ejection electrode which is in a floating state to change a potential of the ejection electrode to an ejection level.

Since the control voltage is not applied to the selected ejection electrode but the adjacent control electrodes, the equipotential surfaces are generated between the adjacent control electrodes and thereby the particulate matter around the selected ejection electrode is not caused to drift away from the selected ejection electrode. Therefore, the high quality of printing is achieved with reliability and stability.

The controller may make the selected ejection electrode floating when it is designated as an ejection dot and applies the control voltage to the two control electrodes adjacent to the selected ejection electrode. The ejection electrodes may be electrically connected to each other when normally floating.

BRIEF DESCRIPTION OF THE DRAWINGS

The above and other objects and advantages will become apparent from the following detailed description when read in conjunction with the accompanying drawings wherein:

FIG. 8 is a control table showing the ON/OFF control of transistors in the circuit of FIG. 7.

DETAILED DESCRIPTION OF THE PREFERRED EMBODIMENTS

Figure 1:
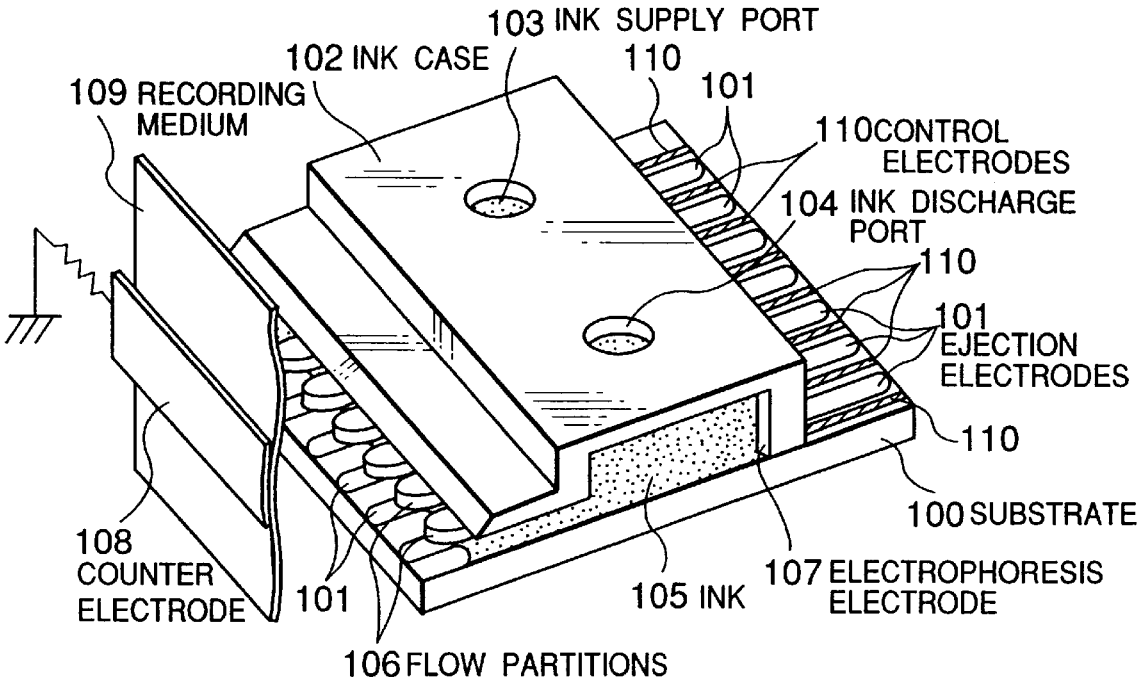
FIG. 1 is a part-fragmentary perspective view showing the printing portion of an electrostatic inkjet recording apparatus according to an embodiment of the present invention.

Referring to FIG. 1, there is shown an electrostatic inkjet recording apparatus according to an embodiment of the present invention. A substrate 100 is made of an insulator such as plastic and has a plurality of ejection electrodes 101 and control electrodes 110 formed thereon which are coated with an insulating film. Each of the ejection electrodes 101 is placed in a position between two adjacent control electrodes 110.

An ink case 102 made of an insulating material is mounted on the substrate 100. The ink case 102 is formed with an ink supply port 103 and an ink discharge port 104. The space, defined by the substrate 100 and the ink case 102, constitutes an ink chamber which is filled with ink 105 containing toner particles which is supplied through the ink supply port 103. The front end of the ink case 102 is formed with a cutout to form a slit-shaped ink nozzle with flow partitions 106 between the ink case 102 and the substrate 100.

The front ends of the ejection electrodes 101 protrude from the ink nozzle to form the ejection portions. On the other hand, the control electrodes 110 does not protrude from the ink nozzle but are located within the ink chamber.

At the inner rear and of the ink case 102, an electrophoresis electrode 107 is provided in contact with the ink 105 within the ink chamber. If voltage with the same polarity as toner particles is applied to the electrophoresis electrode 107, then an electric field will arise in the ink chamber between the electrode 106 and a counter electrode 108 which is grounded through a resistor, causing toner particles to be moved toward the ejection portions of the ejection electrode 101 due to the electrophoresis phenomenon, resulting in an ink meniscus at each ejection portion. In this state, when the potential of an ejection electrode for ink ejection is increased to more than a threshold level, the particulate matter is jetted from the front and of that ejection electrode toward a recording medium 109. In this manner, an image is formed on the recording medium 109. According to the embodiment, as will be described in detail, the potential of an ejection electrode for ink ejection is increased by two adjacent control electrodes 110 to which an ejection control voltage $V_C$ is concurrently applied.

Figure 2:
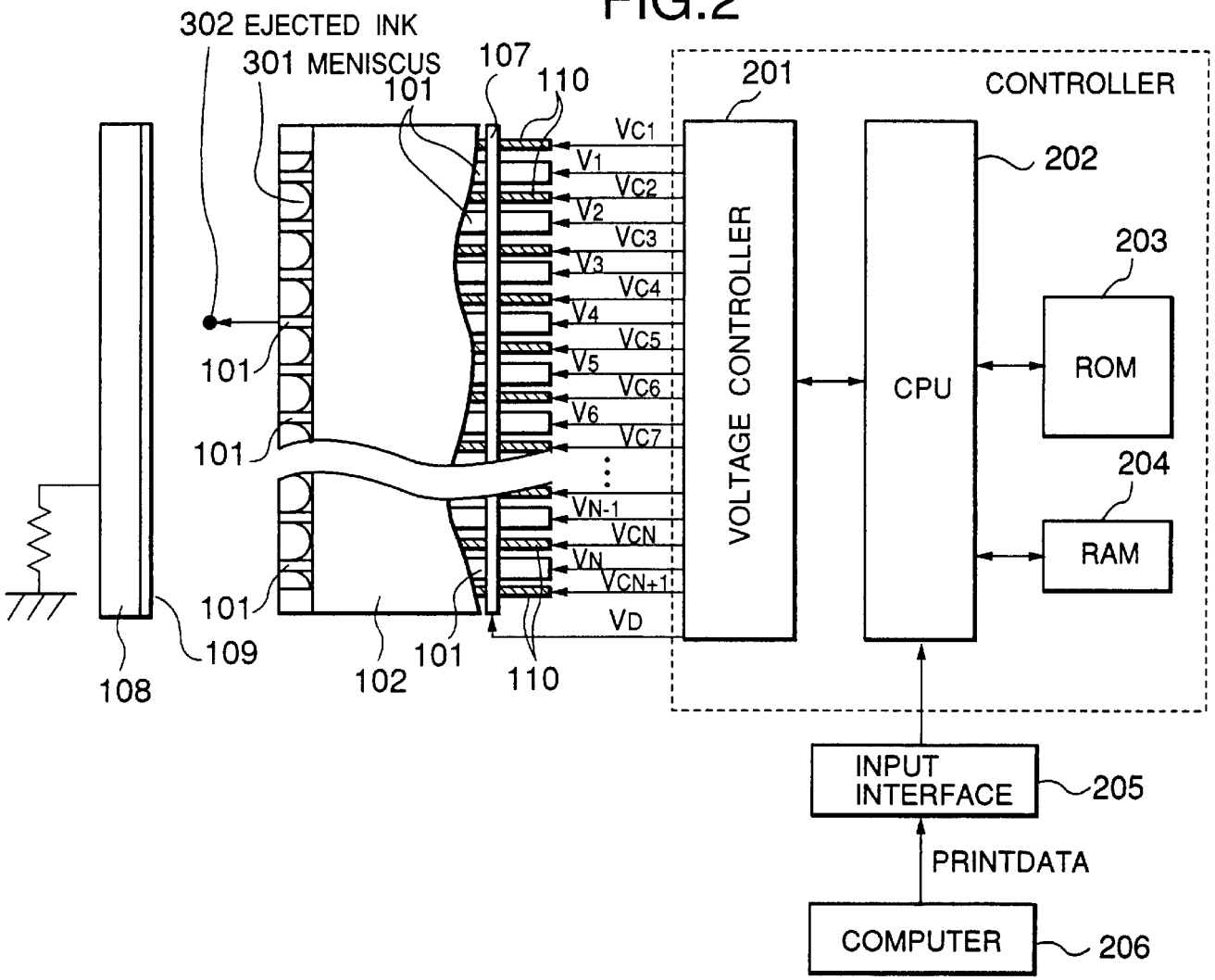
FIG. 2 is a block diagram showing a schematic circuit configuration which drives the electrostatic inkjet recording apparatus according to the embodiment.

Referring to FIG. 2, where elements of the inkjet device similar to those previously described with reference to FIG. 1 are denoted by the same reference numerals, a voltage controller 201 generates voltages $V_1$–$V_N$ applied to the ejection electrodes 101, respectively, and control voltages $V_{C1}$–$V_{CN+1}$ applied to the control electrodes 110, respectively, under the control of a processor (CPU) 202. The voltages $V_1$–$V_N$ and the control voltages $V_{C1}$–$V_{CN+1}$ are controlled such that each of the ejection electrodes 101 is set to one of a ground voltage (or non-ejection bias voltage $V_b$) and a floating state and each of the control electrodes 110 is set to one of an ejection control voltage $V_C$ and the ground voltage.

The processor 202 performs the drive control of the inkjet device according to a control program stored in a read-only memory 203 and controls the voltage controller 201 depending on print data received from a computer 206 through an input interface 205. Further, the processor 202 instructs the voltage controller 201 to apply a predetermined voltage $V_D$ to the electrophoresis electrode 107. More specifically, when powered on, the processor 202 instructs the voltage controller 201 to apply the predetermined voltage $V_D$ to the electrophoresis electrode 107, causing an electric field to be generated in the ink chamber. The electric field moves the particulate matter such as toner particles toward the front ends of the ejection electrodes 101 due to the electrophoresis phenomenon and then the meniscuses 301 are formed at the front ends of the ejection electrodes 101, respectively.

Figure 3:
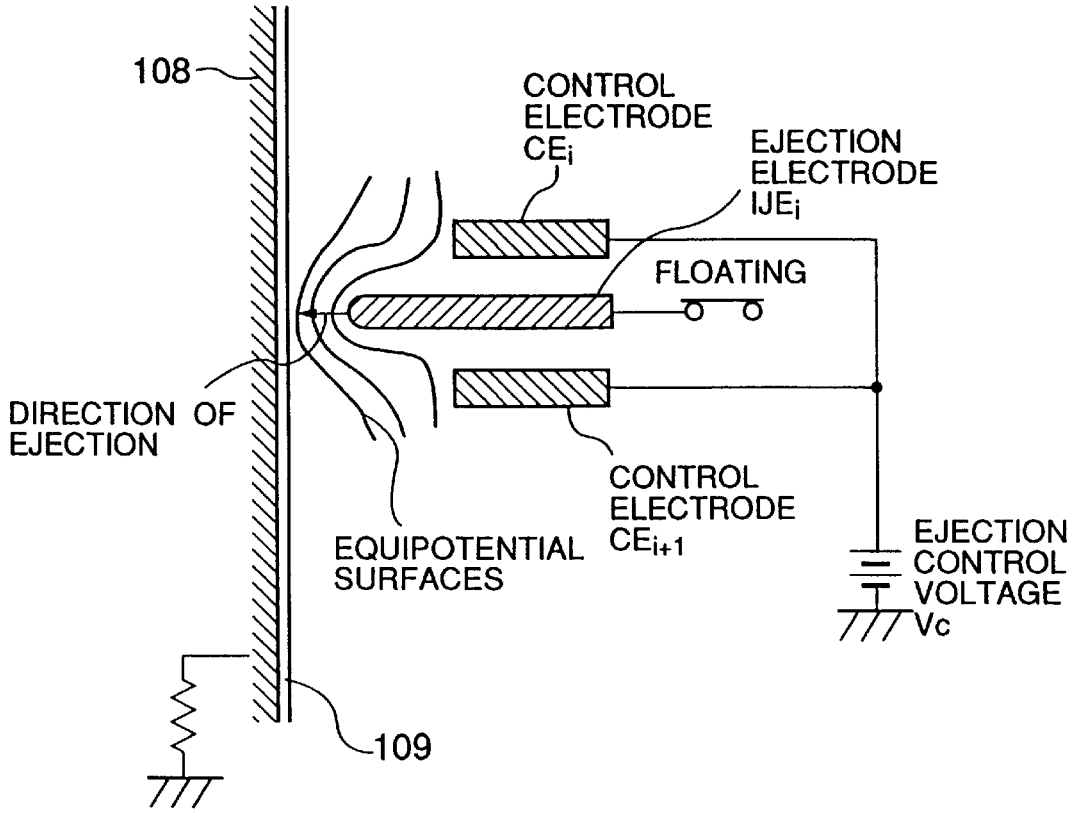
FIG. 3 is a schematic diagram showing equipotentional surfaces generated in an arrangement of ejection electrodes, control electrodes and a counter electrode.
Figure 4:
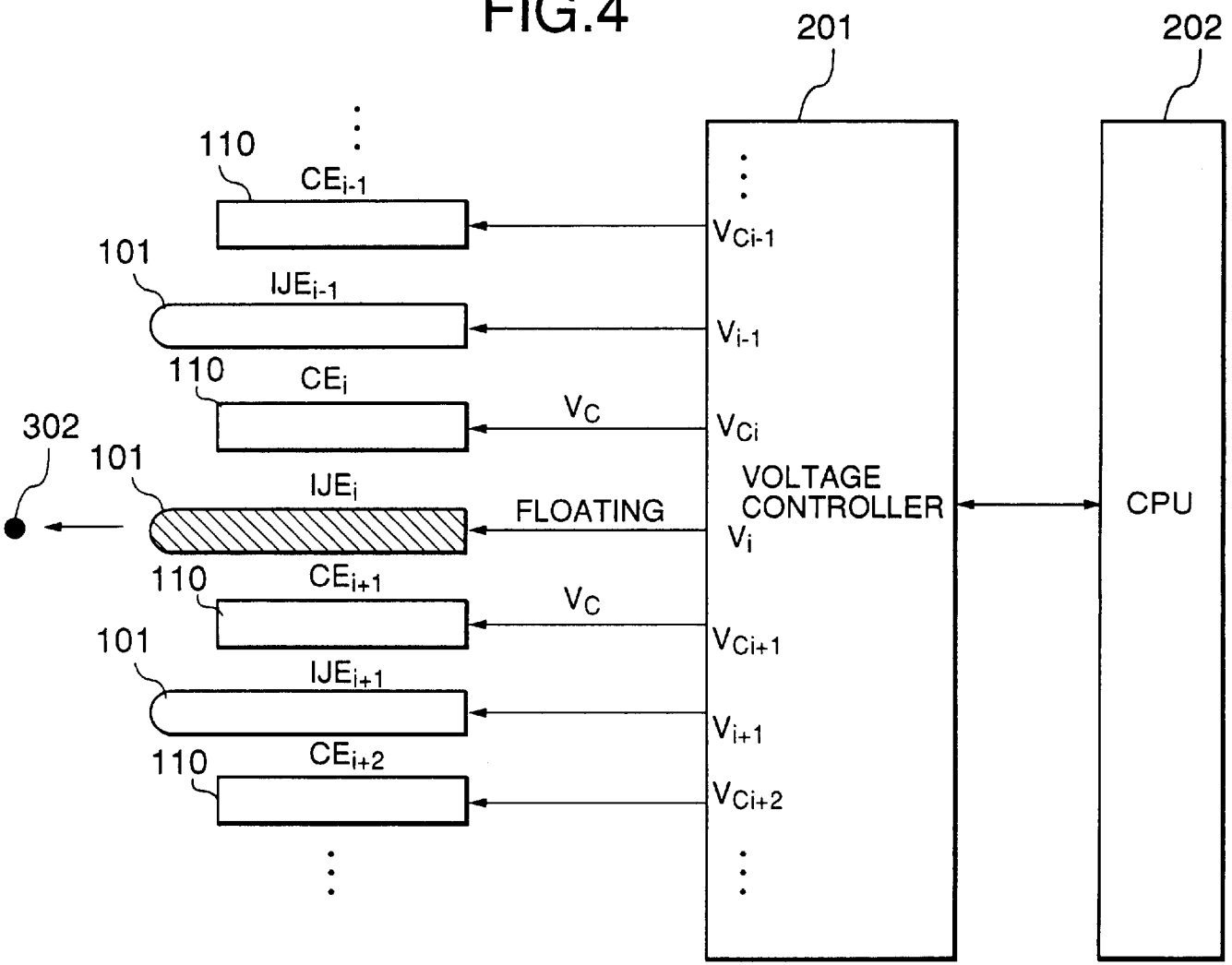
FIG. 4 is a block diagram showing a part of the circuit configuration which drives the electrostatic inkjet recording apparatus according to the embodiment.

Referring to FIGS. 3 and 4, in the case where an ejection electrode $IJE_i$ is designated as an ink ejection dot by the processor 202, the voltage controller 201 makes the ejection electrode $IJE_1$ floating and then the ejection control voltage $V_C$ is applied to the control electrodes $CE_1$ and $CE_{i+1}$ which are adjacent to both sides of the ejection electrode $IJE_i$. Since the ejection electrodes $IJE_i$ is in the floating state, its potential is increased as shown by equipotential surfaces in FIG. 3, resulting in the dramatically reduced amount of the particulate matter in the ink drifting away from the ejection electrode $IJE_i$. Further, the electrostatic force between the ejection electrode $IJE_i$ and the counter electrode 108 is generated along the direction of ejection shown in FIG. 3. When the respective voltages $V_{Ci}$ and $V_{Ci+1}$ applied to the control electrodes $CE_i$ and $CE_{i+1}$ fall from the ejection control voltage $V_C$ to the ground level, the particulate matter 302 is jetted from that ejection electrode $IJE_i$ toward the recording medium 109 as shown in FIG. 4. The details of the ink ejection control will be described hereinafter referring to FIG. 5.

Ejection Control

For simplicity, assuming that three ejection electrodes $IJE_{i-1}$, $IJE_i$ and $IJE_{i+1}$ are sequentially driven to eject the particulate matter 302 successively toward the recording medium 109.

Figure 5:
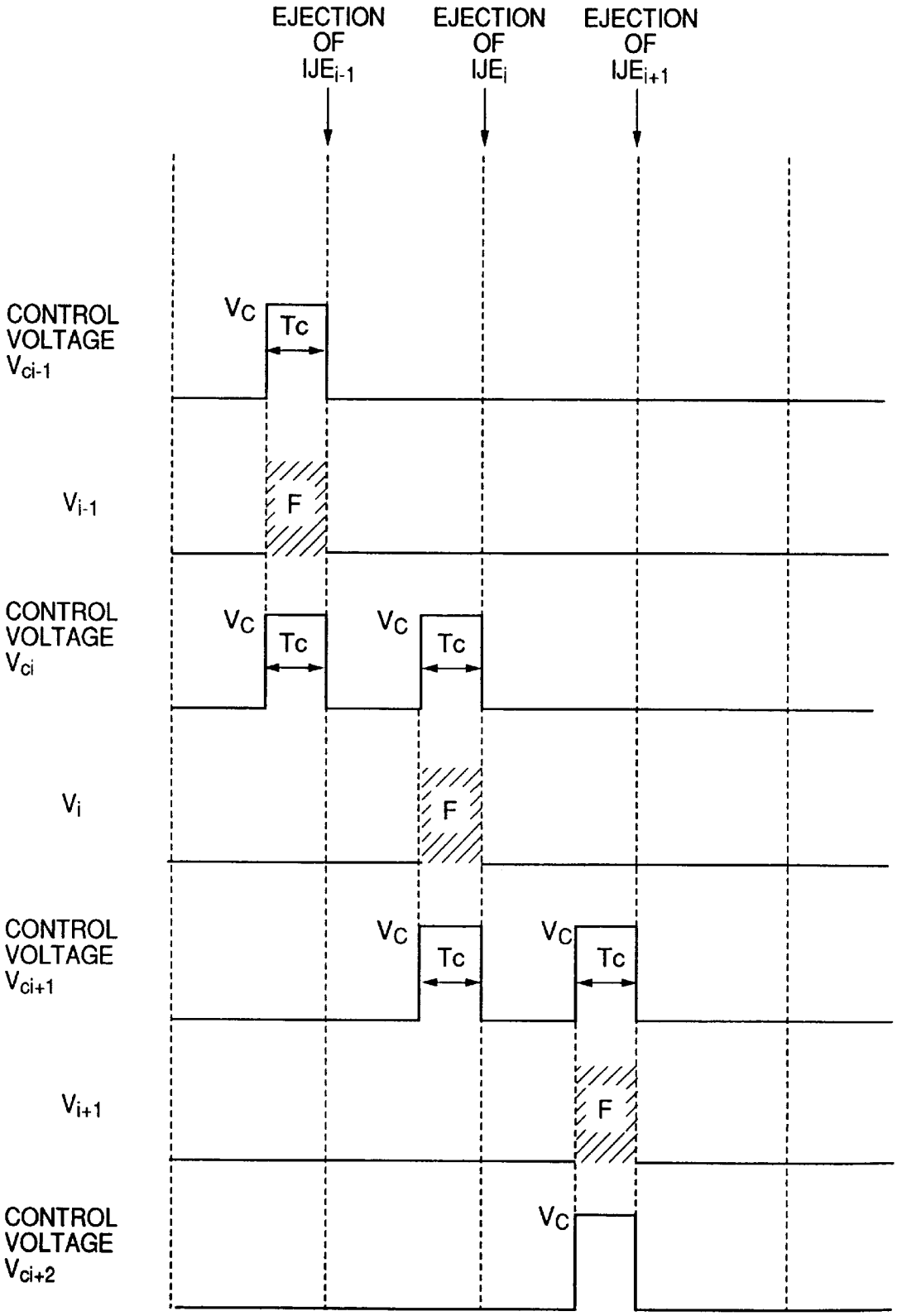
FIG. 5 is a time chart showing an operation of an embodiment of a control method according to the present invention.

Referring to FIG. 5, when the ejection electrode $IJE_{i-1}$ is selected as an ejection dot according to print data and a print control signal received from the computer 206, the voltage controller 201 makes the ejection electrode $IJE_{i-1}$ floating and outputs the ejection control voltage $V_C$ to the adjacent control electrodes $CE_{i-1}$ and $CE_i$ for a predetermined period $T_C$. The ejection control voltage $V_C$ causes the potential of the floating ejection electrode $IJE_{i-1}$ to rise and then the particulate matter 302 is ejected when the voltages applied to the adjacent control electrodes $CE_{i-1}$ and $CE_i$ fall to the ground voltage. At the same time, the ejection electrode $IJE_{i-1}$ is set to a predetermined voltage, for example, a bias voltage Vb by the voltage controller 201.

Subsequently, when the ejection electrode $IJE_i$ is selected as an ejection dot, the voltage controller 201 makes the ejection electrode $IJE_i$ floating and outputs the ejection control voltage $V_C$ to the adjacent control electrodes $CE_i$ and $CE_{i+1}$ for the predetermined period $T_C$. This causes the potential of the floating ejection electrode $IJE_i$ to rise and thereby the particulate matter 302 is ejected on the trailing edge of the pulse voltage $V_C$ as described before. At the same time, the ejection electrode $IJE_i$ is set to a predetermined voltage, for example, a bias voltage Vb by the voltage controller 201. Similarly, when the ejection electrode $IJE_{i+1}$ is selected as an ejection dot, the voltage controller 201 makes the ejection electrode $IJE_{i+1}$ floating and outputs the ejection control voltage $V_C$ to the adjacent control electrodes $CE_{1+1}$ and $CE_{i+2}$ for the predetermined period $T_C$. This causes the particulate matter 302 to be ejected from the floating ejection electrode $IJE_{1+1}$ on the trailing edge of the pulse voltage $V_C$.

Figure 6:
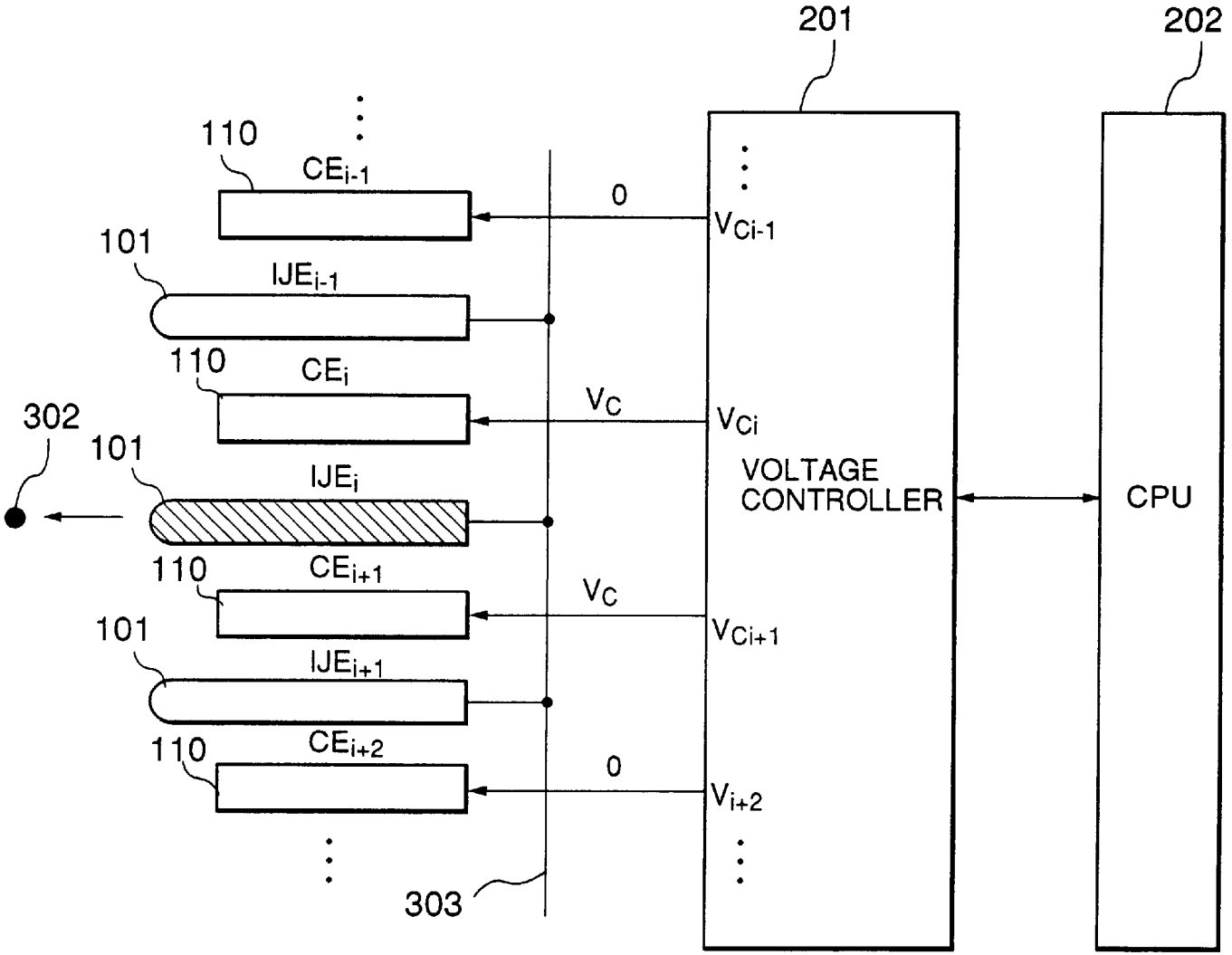
FIG. 6 is a block diagram showing a part of the circuit configuration which drives the electrostatic inkjet recording apparatus according to another embodiment of the present invention.

Referring to FIG. 6, all the ejection electrodes 110 may be connected in common to a floating line 303. In this case, the voltage controller 201 controls only the respective voltages applied to the control electrodes 110. Therefore, the voltage controller 201 can be realized with less amount of hardware and reduced complexity in circuit.

Voltage Controller

The voltage controller 201 provides each ejection electrode or control electrode with a plurality of voltage states including the ground voltage and a floating state under control of the processor 202. If the respective voltages are generated by different power supply units, a plurality of power supply units are needed, resulting in the increased amount of hardware and the increased space and cost. Especially, when an electrode is made floating, a switch corresponding to that electrode is turned off to disconnect the electrode from all power supply units and the ground voltage. Since such a switch is provided for each electrode, high-speed switching is required to increase the inkjet recording speed.

Hereinafter, there is proposed a circuit configuration of the voltage controller 201 which needs a single power supply unit, but it can provide a plurality of voltage states including a floating state.

Figure 7:
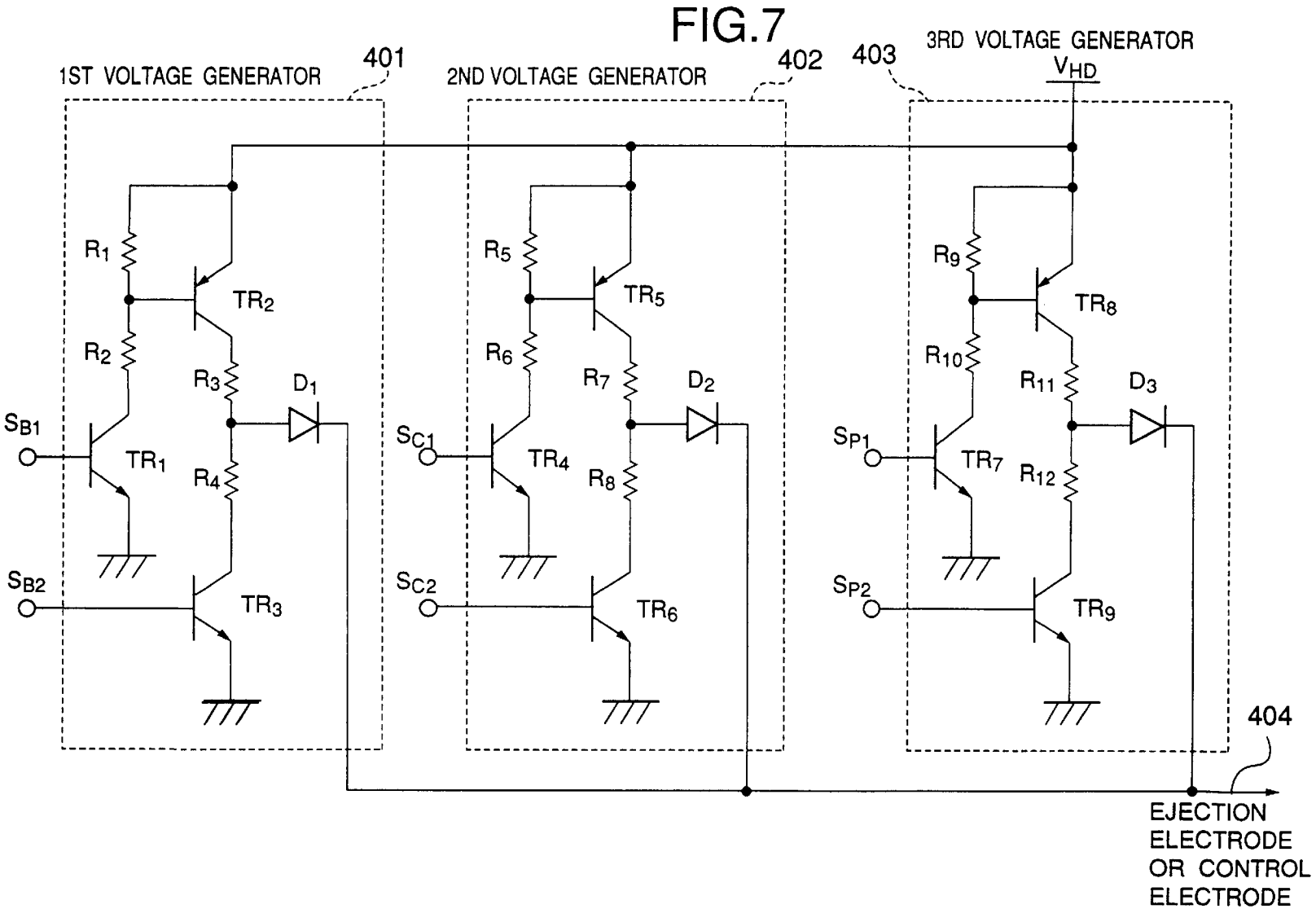
FIG. 7 is a circuit diagram showing an example of the voltage controller in the electrostatic inkjet recording apparatus according to the embodiments.

Referring to FIG. 7, there is shown a voltage control circuit connected to each ejection electrode or control electrode The circuit is comprised of a first voltage generator 401, a second voltage generator 402, and a third voltage generator 403 which are supplied with a single power supply voltage $V_{HD}$. For example, the first to third voltage generators 401, 402 and 403 generate a bias voltage $V_b$, an ejection control voltage $V_C$, and other necessary voltage $V_P$ depending on a first control signal ($S_{S1}$ and $S_{S2}$), a second control signal ($S_{C1}$ and $S_{C2}$), and a third control signal ($S_{P1}$ and $S_{P2}$) received from the processor 202, respectively. The respective output terminals of the first to third voltage generators 401–403 are connected in common to an output line 404 which is connected to the corresponding single ejection electrode 101 or control electrode 110.

The first voltage generator 401 is comprised of npn transistors $TR_1$ and $TR_3$, a pnp transistor $TR_2$, four resistors $R_1$–$R_4$ and a diode $D_1$. The control signals $S_{B1}$ and $S_{B2}$ are received at the bases of the transistors $TR_1$ and $TR_3$, respectively, and the power supply voltage $V_{HD}$ is supplied to the emitter of the transistor $TR_2$. The bias resistor $R_1$ is connected between the emitter and the base of the transistor $TR_2$. The collector of the transistor $TR_1$ is connected to the base of the transistor $TR_2$ through the resistor $R_2$. The respective collectors of the transistors $TR_2$ and $TR_3$ are connected through a series of resistors $R_3$ and $R_4$. The respective emitters of the transistors $TR_1$ and $TR_3$ are grounded. The tap of the series of resistors $R_3$ and $R_4$ is connected to the output line 404 through the diode $D_1$.

The resistors $R_1$ and $R_2$ are determined by the following equations:

$$V_{BE}=-(V_{HD}-V_{HD}R_2/(R_1+R_2)),$$

where $V_{BE}$ is a base-emitter voltage of the transistor $TR_2$. Note that a collector-emitter voltage $V_{CE}$ is negligible when the power supply voltage $V_{HD}$ is sufficiently high. Therefore, when the control signals $S_{B1}$ and $S_{B2}$ cause the transistors $TR_2$ and $TR_3$ to switch ON, the transistor $TR_2$ is also turned on and thereby the first voltage ($V_D$) determined by the following equation appears at the tap of the resistors $R_3$ and $R_4$:

$$V_b=V_{HD}R_4/(R_3+R_4).$$

On the other hand, when the control signals $S_{B1}$ and $S_{B2}$ cause the transistors $TR_2$ and $TR_3$ to switch OFF, the transistor $TR_2$ is also turned off, the tap of the resistors $R_3$ and $R_4$ becomes floating In the case where other voltage generators 402 and 403 are made floating, the first voltage $V_b$ is supplied to the output line 404 through the diode $D_1$. The second and third voltage generator 402 and 403 have a circuit configuration similar to the first voltage generator 401.

The second voltage generator 402 is comprised of npn transistors $TR_4$ and $TR_6$, a pnp transistor $TR_5$, four resistors $R_5$–$R_8$ and a diode $D_2$. The control signals $S_{C1}$ and $S_{C2}$ are received at the bases of the transistors $TR_4$ and $TR_6$, respectively, and the power supply voltage $V_{HD}$ is supplied to the emitter of the transistor $TR_5$. The bias resistor $R_5$ is connected between the emitter and the base of the transistor $TR_5$. The collector of the transistor $TR_4$ is connected to the base of the transistor $TR_5$ through the resistor $R_6$. The respective collectors of the transistors $TR_5$ and $TR_6$ are connected through a series of resistors $R_7$ and $R_8$. The respective emitters of the transistors $TR_4$ and $TR_6$ are grounded The tap of the series of resistors $R_7$ and $R_8$ is connected to the output line 404 through the diode $D_2$.

The resistors $R_5$ and $R_6$ are determined by the following equation:

$$V_{BE}=-(V_{HD}-V_{HD}R_6/(R_5+R_6)).$$

where $V_{BE}$ is a base-emitter voltage of the transistor $TR_5$. Therefore, when the control signals $S_{C1}$ and $S_{C2}$ cause the transistors $TR_4$ and $TR_6$ to switch ON, the transistor $TR_5$ is also turned on and thereby the second voltage (or the ejection control voltage $V_C$) determined by the following equation appears at the tap of the resistors $R_7$ and $R_8$:

$$V_C=V_{HD}R_8/(R_7+R_8).$$

On the other hand, when the control signals $S_{C1}$ and $S_{C2}$ cause the transistors $TR_4$ and $TR_6$ to switch OFF, the transistor $TR_5$ is also turned off, the tap of the resistors $R_7$ and $R_8$ becomes floating. In the case where other voltage generators 401 and 403 are made floating, the second voltage $V_C$ is supplied to the output line 404 through the diode $D_2$.

Similarly, the third voltage generator 403 generates the third voltage determined by the following equation appears at the tap of the resistors $R_{11}$ and $R_{12}$:

$$V_P=V_{HD}R_{11}/(R_{11}+R_{12}).$$

In this manner, by setting the respective pairs of resistors $R_3$ and $R_4$, $R_7$ and $R_8$, and $R_{11}$ and $R_{12}$, a desired voltage can be generated. And, as shown in FIG. 8, a selected one of the first to third voltages $V_D$, $V_C$ and $V_P$ is supplied to the output line 404 and further the output line 404 can be made floating according to the first to third control signals ($S_{B1}$ and $S_{B2}$), ($S_{C1}$ and $S_{C2}$), and ($S_{P1}$ and $S_{P2}$). Since the respective voltage generators are provided with the diodes $D_1$, $D_2$ and $D_3$ at the output stages thereof such that each diode is reverse-biased when the voltage of the output line 404 is higher than the taps of series of resistors $R_3$ and $R_4$, $R_7$ and $R_8$, and $R_{11}$ and $R_{12}$, the output line 404 has no influence on each voltage generator. Therefore, switching all the transistors $TR_1$–$TR_9$ off, based on control signals applied by processor 202, causes the output line 404 to be made floating.

Needless to say, FETs (field effect transistors) or other switching devices may be used instead of bipolar transistors $TR_1$–$TR_9$.

While the invention has been described with reference to specific embodiments thereof, it will be appreciated by those skilled in the art that numerous variations, modifications, and any combination of the embodiments are possible, and accordingly, all such variations, modifications, and combinations are to be regarded as being within the scope of the invention.

What is claimed is:

1. An electrostatic inkjet apparatus comprising:

a plurality of ejection electrodes arranged in an ink chamber containing ink, the ink including particulate matter, the ejection electrodes protruding from a front end of the ink chamber;

a plurality of control electrodes arranged in the ink chamber such that each of the ejection electrodes is placed between two adjacent control electrodes; and a controller for applying a control voltage to two control electrodes adjacent to a selected ejection electrode, which is in a floating state, to change a potential of the ejection electrode to an ejection level.

2. The electrostatic inkjet apparatus according to claim 1, wherein the controller makes the selected ejection electrode floating when it is designated as an ejection dot and applies the control voltage to the two control electrodes adjacent to the selected ejection electrode.

3. The electrostatic inkjet apparatus according to claim 1, wherein the ejection electrodes are normally in the floating state.

4. The electrostatic inkjet apparatus according to claim 3, wherein the ejection electrodes are electrically connected to each other and are normally floating.

5. The electrostatic inkjet apparatus according to claim 1, wherein the controller comprises a plurality of voltage controllers each corresponding to one of the ejection electrodes and the control electrodes, each voltage controller having an output line connected to a corresponding one of the ejection electrodes and the control electrodes, each voltage controller comprising a plurality of voltage generators for generating a plurality of voltages including the control voltage and making the output line floating according to a control signal, each voltage generator being supplied with a predetermined power supply voltage.

6. A control method for an electrostatic inkjet apparatus comprising:

a plurality of ejection electrodes arranged in an ink chamber containing ink, the ink including particulate matter, the ejection electrodes protruding from a front end of the ink chamber; and a plurality of control electrodes arranged in the ink chamber such that each of the ejection electrodes is placed between two adjacent control electrodes, the method comprising the steps of:

setting a selected ejection electrode, which is selected as an ejection dot, to a floating state;

applying a control voltage to two control electrodes adjacent to the selected ejection electrode, which is in a floating state, to change a potential of the selected ejection electrode to an ejection level.

7. The method according to claim 6, wherein the selected ejection electrode is set to a floating state when it is selected as an ejection dot electrode.

8. The method according to claim 6, wherein the ejection electrodes are normally in the floating state.

9. An electrostatic inkjet apparatus comprising:

an inkjet head comprising:

a plurality of ejection electrodes arranged in an ink chamber containing ink, the ink including particulate matter, the ejection electrodes protruding from a front end of the ink chamber; and a plurality of control electrodes arranged in the ink chamber such that each of the ejection electrodes is placed between two adjacent control electrodes;

a data processor for processing print data to produce control data for the ejection electrodes; and a potential controller for controlling a potential of a selected ejection electrode according to the control data received from the data processor such that the selected ejection electrode is set to a floating state and a control voltage is applied to two control electrodes adjacent to the selected ejection electrode, which is in a floating state, to change the potential of the ejection electrode to an ejection level.

10. An electrostatic inkjet apparatus comprising:

a plurality of ejection electrodes arranged in an ink chamber, containing ink, the ink including particulate matter, the ejection electrodes protruding from a front end of the ink chamber, and the ejection electrodes being connected to a floating line;

a plurality of control electrodes arranged in the ink chamber such that each of the ejection electrodes placed between two adjacent control electrodes;

a data processor for processing print data to produce control data for the ejection electrodes; and a potential controller for controlling a potential of a selected ejection electrode according to the control data received from the data processor such that a control voltage is applied to two control electrodes adjacent to the selected ejection electrode to change the potential of the ejection electrode to an ejection level.

11. An electrostatic inkjet apparatus comprising:

an inkjet head comprising:

a plurality of ejection electrodes arranged in an ink chamber containing ink, the ink including particulate matter, the ejection electrodes protruding from a front end of the ink chamber; and a plurality of control electrodes arranged in the ink chamber such that each of the ejection electrodes is placed between two adjacent control electrodes;

a counter electrode for generating a potential with each of the ejection electrodes to eject ink on a recording medium placed on the counter electrode;

a data processor for processing print data to produce control data for the ejection electrodes; and a potential controller for controlling a potential of a selected ejection electrode according to the control data received from the data processor such that the selected ejection electrode is set to a floating state and a control voltage is applied to two control electrodes adjacent to the selected ejection electrode to change the potential of the ejection electrode to an ejection level.

12. An electrostatic inkjet recording system comprising:

an inkjet head comprising:

a plurality of ejection electrodes arranged in an ink chamber containing ink, the ink including particulate matter, the ejection electrodes protruding from a front end of the ink chamber, and the ejection electrodes being electrically connected to a floating line; and a plurality of control electrodes arranged in the ink chamber such that each of the ejection electrodes is placed between two adjacent control electrodes;

a counter electrode for generating a potential with each of the ejection electrodes to eject ink a recording medium placed on the counter electrode;

a data processor for processing print data to produce control data for the ejection electrodes; and a potential controller for controlling a potential of a selected ejection electrode according to the control data received from the data processor such that a control voltage is applied to two control electrodes adjacent to the selected ejection electrode to change the potential of the ejection electrode to an ejection level.

* * * * *